US012631174B2

(12) United States Patent
Albrecht et al.

(10) Patent No.: US 12,631,174 B2
(45) Date of Patent: May 19, 2026

(54) ELECTROHYDRAULIC DRIVE SYSTEM

(71) Applicant: HYDAC Drive Center GmbH, Langenau (DE)

(72) Inventors: Harald Albrecht, Königsbronn (DE); Martin Rehbein, Ichenhausen (DE); Edgar Weisshaupt, Zweilbrücken (DE); Wolfgang Wiest, Ulm (DE)

(73) Assignee: HYDAC DRIVE CENTER GMBH, Langenau (DE)

( * ) Notice: Subject to any disclaimer, the term of this patent is extended or adjusted under 35 U.S.C. 154(b) by 0 days.

(21) Appl. No.: 18/872,424

(22) PCT Filed: Jun. 19, 2023

(86) PCT No.: PCT/EP2023/066496
§ 371 (c)(1),
(2) Date: Dec. 6, 2024

(87) PCT Pub. No.: WO2024/008432
PCT Pub. Date: Jan. 11, 2024

(65) Prior Publication Data

US 2026/0002528 A1 Jan. 1, 2026

(30) Foreign Application Priority Data

Jul. 8, 2022 (DE) ..... 10 2022 117 052.7

(51) Int. Cl.
*F04B 53/00* (2006.01)
*F04B 17/03* (2006.01)
*F04B 53/16* (2006.01)

(52) U.S. Cl.
CPC ..... *F04B 53/003* (2013.01); *F04B 17/03* (2013.01); *F04B 53/16* (2013.01)

(58) Field of Classification Search
CPC ..... F04B 53/003; F04B 17/03
See application file for complete search history.

(56) References Cited

U.S. PATENT DOCUMENTS 2,825,286 A * 3/1958 White ..... F04C 11/008 417/371
3,672,793 A * 6/1972 Yowell ..... F04B 1/2064 417/415

(Continued)

FOREIGN PATENT DOCUMENTS

DE 9317524 U1 2/1994 ..... F01C 21/00
DE 4203619 C2 7/1996 ..... F04B 1/20

(Continued)

OTHER PUBLICATIONS

Search Report for International Application No. PCT/EP2023/066496, 4 pages, Sep. 22, 2023.

*Primary Examiner* — Thomas E Lazo
(74) *Attorney, Agent, or Firm* — Slayden Grubert Beard PLLC

(57) ABSTRACT

The disclosure relates to an electrohydraulic drive system comprising an electric motor and a fluid pump that can be driven by the electric motor via an output shaft and has a rotor, which is rotatably guided in a stator surrounded by a housing of the electric motor, and a pump housing. A damping block is inserted between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and the bearing shell of which is directly supported against the damping block.

21 Claims, 1 Drawing Sheet

(56) References Cited

U.S. PATENT DOCUMENTS

| | | | | |
|---|---|---|---|---|
| 3,897,178 | A * | 7/1975 | Palloch | F04D 13/06 417/369 |
| 5,320,501 | A * | 6/1994 | Langosch | F04B 17/03 417/357 |
| 5,332,371 | A | 7/1994 | Dantlgraber et al. | 417/363 |
| 7,182,583 | B2 * | 2/2007 | Gandrud | H02K 7/14 417/32 |
| 10,436,228 | B2 | 10/2019 | Kemnitz et al. | |
| 11,193,491 | B2 * | 12/2021 | Simon | F04C 29/0085 |
| 11,795,926 | B2 * | 10/2023 | Joa | F16H 39/14 |
| 2010/0290933 | A1 | 11/2010 | Tabata | |
| 2015/0267701 | A1 | 9/2015 | Pippes et al. | 417/410.4 |
| 2020/0347847 | A1 | 11/2020 | Simon | |
| 2021/0048008 | A1 | 2/2021 | Joa | |

FOREIGN PATENT DOCUMENTS

| | | | | |
|---|---|---|---|---|
| DE | 102013008678 | A1 | 11/2014 | F04B 1/20 |
| DE | 102016114540 | A1 | 2/2018 | F04C 15/00 |
| EP | 2921703 | A2 | 9/2015 | F01C 21/10 |
| JP | 3078578 | B2 | 8/2000 | B60T 8/36 |

* cited by examiner

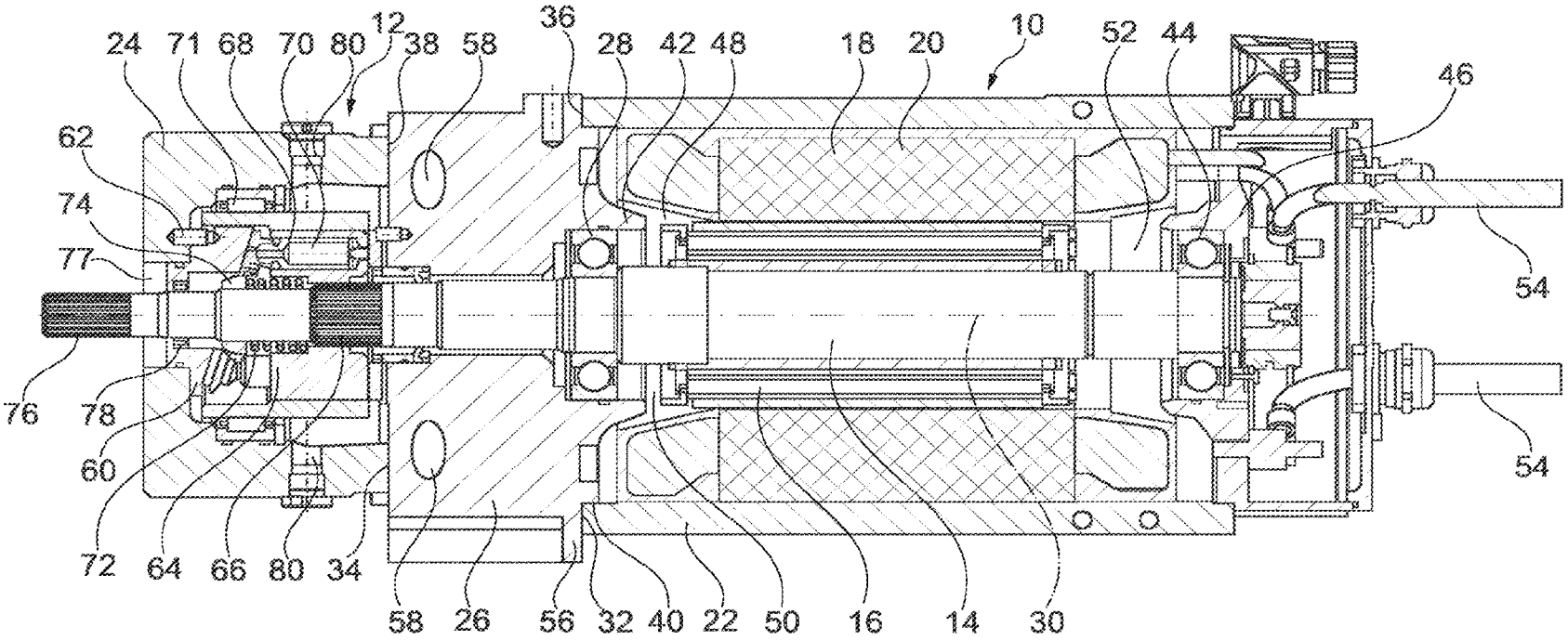
54
54
46
44
52
10
20
18
48
42
28
36
58
38
12
80
70
68
71
24
62
74
77
76
78
60
72
64
66
80
34
58
26
56
32
40
22
50
16
14
30

ELECTROHYDRAULIC DRIVE SYSTEM

CROSS-REFERENCE TO RELATED APPLICATIONS

This application claims priority to German Patent Application No. DE 10 2022 117 052.7, filed on Jul. 8, 2022 with the German Patent and Trademark Office. The contents of the aforesaid Patent Application are incorporated herein for all purposes.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

The disclosure relates to an electrohydraulic drive system comprising an electric motor and a fluid pump that can be driven by the electric motor via an output shaft and has a rotor, which is rotatably guided in a stator surrounded by a housing of the electric motor and comprising a pump housing.

In the ongoing transition to what is known as e-mobility, internal combustion engines are also being replaced by electric synchronous motors and in this process, both the hydrostatic drives for the traction drive of an operating machine, and also the drive for the corresponding hydraulic operating system are operated by corresponding synchronous motors. Internal combustion engines were previously the main factor behind vehicle noise and the transition to electric drive components will now make fluid or hydraulic pumps an increasingly determining factor with regard to noise levels in vehicles in which such drive systems are installed. While an electric drive operates with very little noise, add-on components such as fluid pumps are the kind of items that cause disruptive noises.

SUMMARY

A need exists to provide an improved electrohydraulic drive system in which the components operate with little noise. The need is addressed by the subject matter of the independent claim(s). Embodiments of the invention are described in the dependent claims, the following description, and the drawing.

BRIEF DESCRIPTION OF THE DRAWING

The FIGURE shows a basic outline of a longitudinal section through main components of an example drive system.

DESCRIPTION

The details of one or more embodiments are set forth in the accompanying drawings and the description below. Other features will be apparent from the description, drawings, and from the claims.

In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In some embodiments, a damping block is inserted between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and the bearing shell of which is directly supported against the damping block. This achieves a significant sustainable reduction in the noise level for the entire drive system. The aforementioned damping block, which is accordingly configured to be a solid structure, and in particular consists of a steel material, represents an effective radial and axial noise measure to reduce noise and the corresponding arrangement is fully compatible with the special noise requirements for drive systems with synchronous motors, which in this respect replace noisy internal combustion engines as primary noise damping. In particular, some of the bearing noise during operation of the output shaft is passed directly into the damping block. An average expert in the field of such drive systems would find it surprising that the drive system solution according to the teachings herein achieves operation substantially without noise emissions, especially as metallic materials are used for noise damping instead of the elastomer materials, such as rubber, for example, that are usually used.

As an effective partitioning between the hydraulic and the electrical part of the drive system is achieved by the damping block, fluidic decoupling between the hydraulic and electrical unit is also achieved. As, when using hydraulic equipment, in this case in connection with operating the fluid pump, a certain degree of contamination and water content in the operating fluid arises, the aforementioned decoupling always ensures that the electric motor can be operated without any risk of short-circuiting. Furthermore, separating the hydraulic and electric parts ensures improved cooling for each of these components.

Furthermore, a modular structure for the drive system in its entirety with its electric motor and fluid pump components is obtained such that the drive system can easily be adjusted to changing performance requirements, for example if a larger capacity is required. A more than acceptable noise level is also achieved for the overall drive system in the corresponding case as a result of the damping block. In particular, the damping block can be used as a standardisable basic component to which a wide variety of types of electric motors and fluid pumps can be connected on opposite sides of the damping block. This therefore has no parallel in the prior art.

In some embodiments of the electrohydraulic drive system, it has therefore proved beneficial if the damping block spans a prism with respect to the surrounding area, for example in the form of a hexagonal prism, for example in the form of an octagonal prism. Due to the corresponding prismatic clamping, a variety of refracting edges are formed, on which the noise arising during operation is able to refract accordingly, leading to a clear reduction in noise emissions.

In some embodiments of the electrohydraulic drive system, it is provided that the output shaft comprises a coupling point at one of its free end regions for connecting a drive shaft of the fluid pump, said coupling point being surrounded by the damping block, and in that the bearing point for the output shaft and the coupling point of the drive shaft for the fluid pump are inserted in the damping block on opposite end faces thereof. Therefore the coupling point is received in the damping block, the vibrations arising during operation of the shafts, which may also determine noise emission, are damped accordingly.

In some embodiments of the electrohydraulic drive system, it is provided that individual fluid passages pass through the damping block, which serve to supply and discharge fluid, such as a hydraulic or cooling medium, which have a damping effect when flowing through the damping block. Alongside the additional damping effect, in this manner, short paths are created for supplying and discharging hydraulic and/or cooling media, which proves favourable in energy terms for the drive system as a whole.

With regard to vibrations and also with a view to ensuring low-noise production, it has proven effective if the overall axial length of the damping block, viewed in the direction of the output shaft, approximately corresponds to the overall axial length of a pump housing of the fluid pump.

In some embodiments of the electrohydraulic drive system, it is provided that the output shaft is mounted via a further bearing point, which is received in a cover part of the electric motor at the opposite end region to one bearing point, said cover part sealing the electric motor on its side facing away from the damping block. For example, in this case, one of the bearing points for the output shaft forms an integral part of a shield-like cover part of the electric motor housing and the other bearing point forms an integral part of the end part, which is formed by the damping block. In this manner, longitudinal and transverse forces are securely absorbed on the output shaft of the electric motor by means of the individual bearing points, only two bearing points in total being sufficient to ensure reliable support and a kind of 'floating mounting system'. By virtue of the corresponding bearing point arrangement with one bearing point in the damping block and a further bearing point in the shield-like cover part, the respective bearing point is protected from the environment and a low-noise drive for the fluid pump can be ensured via the output shaft of the electric motor, even in the region of the bearing points. In particular, bending vibrations from the output shaft are avoided, specifically by mounting the cylinder drum of the pump at the point of application of the resulting force.

It has proven beneficial if both an end wall of the electric motor housing and an end wall of the pump housing are placed flush on opposite end faces of the damping block so that any vibrations are passed into the damping block from both sides, said damping block thus assuming a central role as damping for the overall drive system. Furthermore, the damping block also provides a centrally located assembly aid for safe assembly of the overall drive system with its various components.

To ensure a good damping action, it has also proven beneficial if the outer diameter of the electric motor housing is selected such that it is larger than the outer diameter of the pump housing so that good support is provided for the pump, even during operation thereof, via the accordingly damping electric motor housing.

In some embodiments of the electrohydraulic drive system, it is provided that the damping block at the bearing point tapers conically in the direction of a seat in the housing of the electric motor, which, with adjacent conical wall parts of the electric motor, delimits a funnel-shaped sound chamber. By virtue of the funnel-shaped sound chamber, any sound waves can be damped in a targeted manner, thus preventing noise emissions.

In some embodiments of the electrohydraulic drive system, it is provided that the damping block is manufactured as a stand construction and in that the housing of the electric motor and the pump housing are connected to the stand formed in this manner on opposite sides. As such, within a wide scope, the drive system can also be installed subsequently in almost any operating machinery in hydraulic systems and any noise-generating vibrations of the drive system in its entirety can be diverted in a targeted manner via the base of the stand into the substrate, such as a machine base or similar.

In the electrohydraulic drive system, it can for example be provided that the fluid pump then acts as a hydraulic motor in a reversing operation, said hydraulic motor driving the electric motor to produce electricity in generator operation. In this manner, a four-quadrant operation can be achieved such that the pump assumes a hydraulic motor function and the synchronous motor acts as an electricity-producing generator. In this process, it is particularly beneficial if the drive system, from the perspective of its component design, permits both the aforementioned operating options, combined in one unit, such that various applications can be covered with just one structural unit during operation of mobile work machinery.

The fluid pump is for example a swash plate machine, the individual delivery pistons of which are supported at one end on a fixed swash plate, the individual delivery pistons being guided, one after the other, from different piston positions in each case, in axial displacement directions parallel to the longitudinal axis of the output shaft, in order to perform a pump movement in piston chambers of a housing part which are also guided rotatably by means of the output shaft. The use of a swash plate machine or axial piston machine, respectively, has proven to be functionally reliable because the individual delivery pistons are guided in a low-friction manner for their respective axial pump movement in the fluid of a corresponding piston chamber of a pump housing part. However, external and internal gear pumps can also easily be used as fluid pumps, these being generally less prone to noise emissions during operation despite their engaging teeth.

The housing part with the individual piston chambers and the received delivery pistons can be clamped by means of an energy accumulator, for example in the form of a compression spring, in the direction of the swash plate. By virtue of the aforementioned energy accumulator, tolerances during operation of the fluid pump can be compensated, but in particular this serves to ensure contact between the cylinder drum and the control surface, when not in pressurised operation, when the pump is in any position in the chamber.

Alternatively, instead of a one-piece output shaft, it can be provided that the output shaft and an independent drive shaft of the fluid pump are connected together via a coupling, such as a splined shaft arrangement. In this manner, it is simple to assemble the overall drive system and the fluid pump, together with its drive shaft, can easily be removed from the damping block and the output shaft guided therein by detaching for maintenance or repair purposes. In this manner, an old fluid pump can be exchanged for a new fluid pump without any effort.

Provided that, for example, the output shaft is removed via an axially arranged access opening on the free end face of the pump housing, and has a coupling piece on its free end, which is removed from the pump housing, for example configured as a further splined shaft arrangement, and serves to connect third-party components, such as a further fluid pump, as part of an overall delivery concept, the pump power for the drive system can be increased still further in a low-noise manner by connecting together a plurality of fluid pumps.

The electrohydraulic drive system is described below in greater detail by means of an example of an embodiment according to the drawing, in which the only figure shows a basic outline of a longitudinal section through the main components of such a drive system.

Specific references to components, process steps, and other elements are not intended to be limiting. Further, it is understood that like parts bear the same or similar reference numerals when referring to alternate FIGS.

The electrohydraulic drive system shown in the FIGURE comprises, in its entirety, an electric motor 10 and a fluid pump 12, which can be driven by the electric motor 10 via an output shaft 14. The output shaft 14 has a rotor 16, which is rotatably guided in a stator 18 with a coil winding 20 in the customary manner for an electric motor 10, said stator 18 or the coil winding 20 respectively being surrounded by a cylindrical housing 22 of the electric motor 10.

In order to reduce noise emissions of any kind, a solid, metallic damping block 26 is inserted between the electric motor housing 22 and a pump housing 24, through which the output shaft 14 passes in full, said output shaft being guided in a bearing point 28 in the damping block 26. The damping block 26 is configured to be substantially hollow-cylindrical to allow the output shaft 14 to pass through. As is also shown in the FIGURE, the overall axial length of the damping block 26, viewed in the direction of the longitudinal axis 30 of the output shaft 14, is approximately the same size as the overall axial length of the pump housing 24 in the same orientation as the longitudinal axis 30. In particular, the electric motor housing 22, the pump housing 24 and the damping block 26 are arranged in a concentric arrangement with respect to the longitudinal axis 30. In particular, the hollow damping block 26 spans a prism with a large number of refracting edges with respect to the surrounding area.

Both an end wall 32 of the electric motor housing 22 and an end wall 34 of the pump housing 24 are placed flush on opposite end faces 36 or 38 respectively of the damping block 26. For this purpose, a step 40 with a reduced diameter is provided on the end wall 36 of the damping block 26, the cylindrical end region of the electric motor housing 22 protruding over said step at this point. Furthermore, a circumferential wall extension 42 protruding in the direction of the rotor 16 is inserted in the corresponding end face 36, said wall extension receiving the bearing point 28. In contrast, the flat end wall 34 of the pump housing 34 is arranged flat, for example screwed firmly onto the opposite end face 38 of the damping block 26 such that it can be detached again. As such, the damping block 26 forms a kind of bearing shield or connection plate for the device as a whole.

To ensure that vibrations are applied favourably with a corresponding damping action, it has proven favourable if the outer diameter of the electric motor housing 22 is selected such that it is larger than the outer diameter of the pump housing 24, in which case the outer diameter of the damping block 26 lies between the aforementioned outer diameters.

The output shaft 14 is mounted on the rear side via a further bearing point 44, which is received in a shield-like cover part 46 of the electric motor 10 at the opposite end region to one bearing point 28, said cover part sealing said electric motor 10 hermetically with respect to the environment on its side facing away from the damping block 26.

The wall extension 42 is configured such that it tapers conically in the direction of the longitudinal axis 30 of the output shaft 14 and delimits, with adjacently arranged parts of the coil winding 20, a funnel-shaped sound chamber 48, which is suited to diverting any noise emissions from the fluid pump 12 in the direction of a central receiving space 50 for the output shaft 14; a space 50, which is noise-insulated with respect to the environment by the housing 22 and the stator 18. In this case, it is also beneficial that the central receiving space 50, towards its other end, emerges into a further sound chamber 52 with comparable conicity and spatial 'capacity' to the first sound chamber 48, which provides a further damping option, with respect to possible 'accumulated' sound waves in the central receiving space 50.

As is also shown in the FIGURE, this further sound chamber 52 widens in the direction of the hollow-cylindrical cover part 56 with the further bearing point 44. As shown, the cover part 46 is securely connected, but in a detachable manner, to the circumferential jacket of the housing 22 and has two access points on the outer wall side for the electrical connection 54 in the form of two supply cables between the coil windings 20 and a power supply source, which is not shown in further detail.

Furthermore, in the viewing direction shown on the FIGURE, the lower side of the damping block 26 comprises a web-like stand arrangement 56 protruding downwards, by means of which it is possible to stand or secure, respectively, the bottom of the drive system in its entirety via the damping block 26 to a third-party component (not shown), such as a machine part. Also in this manner, vibration-related noise emissions can be effectively diverted in a damping manner via the stand device 56 into an adjacent machine part. As shown, passages or openings 58 may pass through the damping block 26, serving to supply and discharge pump fluid for the fluid pump 12, which generally also applies a damping action when passing through the damping block 26 in the form of a hydraulic medium. In this manner, cooling fluid can also be supplied to the electric motor 10 during operation thereof, although this is not shown in greater detail. A coolant supply for the fluid pump 12 would also be possible in this manner. As the stand component 56 forms a kind of mounting interface for the pump 12 and the electric motor 10, a balanced stand support is achieved, which has also proven beneficial in respect of suppressing noise emissions.

The structure of the fluid pump 12 is explained in further detail below, this being designed as a so-called swash plate machine in this example of an embodiment. Corresponding fluid pumps can be identified in a large number of models in the prior art, for example in DE 10 2013 008 678 A1, with the result that the fluid pump 12 is only described in very general terms, insofar as this is necessary to understand the teachings herein. The axial piston pump in the swash plate design shown in the FIGURE has a swash plate 60, which is arranged in a stationary manner in the pump housing 24 and is held in position by means of at least one cylinder pin 62. As, in the present embodiment, the swash plate 60 is not movable, unlike in DE 10 2013 008 678 A1, this thus forms a kind of fixed displacement pump as a fluid pump 12 with a constant delivery volume. Furthermore, the fluid pump 12 comprises a cylindrical pump housing part 64, which is non-rotatably connected by means of a splined shaft arrangement 66 to the output shaft 14 and can be driven in rotation by the latter. In this case, the associated lateral surface is rotatably guided along a third bearing point 71 in the pump housing 24.

As shown in the sectional plane lying above the longitudinal axis in the FIGURE, individual piston chambers 68 are accommodated in the housing part 64, in which individual assigned delivery pistons 70 are guided in a longitudinally movable manner. For the sake of simplicity, only one piston chamber 68 with an assigned delivery piston 70 is shown in the FIGURE, a plurality of such delivery pistons 70 being distributed concentrically around the longitudinal axis 30 at uniform intervals from one another around the output shaft 14. Due to the inclined position of the swash plate 60, the delivery piston 70 shown is located in its lowermost fluid-discharging delivery position, whereas on the side arranged diametrically opposite the longitudinal axis 30 of the output shaft 14, a delivery piston is received in the housing part 64 in its uppermost position, in which the maximum possible delivery volume of the fluid pump 12 is obtained in the associated piston chamber 68. In the lowermost position, as shown for the upper delivery piston 70, during pump operation the correspondingly received fluid quantity is discharged again from the pump housing part 64 to supply a hydraulic consumer, such as an operating cylinder, for example, which is not shown in further detail.

The respective delivery pistons 70, which take in and discharge fluid, are connected with their respective piston base of each piston chamber 68 to corresponding fluid supply and discharge lines, which, for the sake of simplicity and for improved clarity, are omitted in the FIGURE. In addition to fluid supply and removal via the passages 58 in the damping block 26, it is also possible to attach correspondingly assignable lines via the free outer end face of the pump housing 24, if necessary, and in this manner to connect the pump 12 to a supply circuit, which is not shown.

By virtue of the aforementioned splined shaft arrangement 66, the pump housing part 64 is movably guided coaxially with respect to the longitudinal axis 30 on the output shaft 14 and, by virtue of an energy accumulator in the form of a compression spring 72, the housing part 64 is clamped with its individual delivery pistons 70 in the direction of the swash plate 72 via an additional contact sleeve 74. In this case the compression spring 72 is supported with one of its free ends on the corresponding contact sleeve 74 in the direction of the swash plate 60 and with its other free end on a housing-side receiving space of the pump housing part 64, which faces the splined shaft arrangement 66.

The output shaft 14 according to the FIGURE is configured in one piece and emerges at one of its free ends into a further splined shaft arrangement 76. The one-piece output shaft 14, which is removed from the pump housing 24 at the end via an axially arranged access opening 77, is guided via the two bearing points 28 and 44, which, in the usual manner, are held in position by means of retaining rings, and which may consist of bearings of the conventional design, such as, for example a ball bearing. However, it is also possible to replace an individual bearing point with a bearing bush with good sliding properties, which is not shown in further detail. If the output shaft 14 with its further splined shaft arrangement 76 protrudes beyond the end wall of the pump housing 24, a seal 78 is formed at this point by a constriction in the swash plate 60. In an embodiment that is not shown in further detail, however, the described overhang with the further splined shaft arrangement 76 may also be omitted by using only one fluid pump 12, and, as such, the pump housing 24 would need to be furnished in a sealing manner with a sealing cover on its free outside end face.

In addition, with the drive system according to the teachings herein as shown in the FIGURE, a so-called reversing or four-quadrant operation is possible, in which the fluid pump 12 acts as a hydraulic motor and the output shaft 14, which is then driven by the fluid pump 12, generates a variable electrical field in the stator 18 by means of its rotor 16 such that the electric motor 10 then produces an electrical current in generator operation, said current being transmitted in the conventional manner to an electrical consumer (not shown) via the electrical connection 54. Instead of a fluid pump 12 in a swash plate design, a different fluid pump, which is not shown in further detail, may also be used, for example in the form of an internal and/or external gear machine. However, ultimately, with the present solution, the delivery pistons 70 are guided inside the piston chambers 68 and, as such, enclosed in said chambers, which also contributes to noise reduction.

The converted electrical-hydraulic power is obtained from the drive speed and the pressure in the operating line that discharges fluid and is not shown in further detail plus a possible leakage volume flow, which is discharged from the pump housing 24 via at least one separate leakage oil port 80, which is in each case sealed by a plug before commissioning as shown in the FIGURE. All components used in the drive system are for example designed in a solid construction, which applies in particular to the solid damping block 26, with the result that low-noise behaviour is achieved during operation due to the very rigid structure. If necessary, other noise-reduction measures may be taken, for example by using additional damping inserts (not shown) in the housings 22 and 24.

The invention has been described in the preceding using various exemplary embodiments. Other variations to the disclosed embodiments may be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, device, or other unit may be arranged to fulfil the functions of several items recited in the claims. Likewise, multiple processors, devices, or other units may be arranged to fulfil the function of several items recited in the claims.

The term "exemplary" used throughout the specification means "serving as an example, instance, or exemplification" and does not mean "preferred" or "having advantages" over other embodiments. The term "in particular" and "particularly" used throughout the specification means "for example" or "for instance".

The mere fact that certain measures are recited in mutually different dependent claims or embodiments does not indicate that a combination of these measures cannot be used to advantage. Any reference signs in the claims should not be construed as limiting the scope.

What is claimed is:

1. A electrohydraulic drive system comprising an electric motor and a fluid pump that can be driven by the electric motor via an output shaft and has a rotor, which is rotatably guided in a stator surrounded by a housing of the electric motor, and a pump housing, wherein a damping block is arranged between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and a bearing shell of which is directly supported against the damping block;

wherein the damping block spans a prism with respect to the surrounding area.

2. The electrohydraulic drive system of claim 1, wherein the output shaft comprises a coupling point at one of its free end regions for connecting a drive shaft of the fluid pump, said coupling point being surrounded by the damping block, and wherein the bearing point for the output shaft and the coupling point of the drive shaft for the fluid pump are inserted in the damping block on opposite end faces thereof.

3. The electrohydraulic drive system of claim 2, wherein individual fluid passages pass through the damping block, which serve to supply and discharge fluid, which have a damping effect when flowing through the damping block.

4. The electrohydraulic drive system of claim 2, wherein the overall axial length of the damping block, viewed in the direction of the output shaft, approximately corresponds to the overall axial length of a pump housing of the fluid pump.

5. The electrohydraulic drive system of claim 2, wherein the output shaft is mounted via a further bearing point, which is received in a cover part of the electric motor at the opposite end region to one bearing point, said cover part sealing the electric motor on its side facing away from the damping block.

6. The electrohydraulic drive system of claim 1, wherein individual fluid passages pass through the damping block, which serve to supply and discharge fluid, which have a damping effect when flowing through the damping block.

7. The electrohydraulic drive system of claim 6, wherein the overall axial length of the damping block, viewed in the direction of the output shaft, approximately corresponds to the overall axial length of a pump housing of the fluid pump.

8. The electrohydraulic drive system of claim 1, wherein the overall axial length of the damping block, viewed in the direction of the output shaft, approximately corresponds to the overall axial length of a pump housing of the fluid pump.

9. The electrohydraulic drive system of claim 1, wherein the output shaft is mounted via a further bearing point, which is received in a cover part of the electric motor at the opposite end region to one bearing point, said cover part sealing the electric motor on its side facing away from the damping block.

10. The electrohydraulic drive system of claim 1, wherein both an end wall of the electric motor housing and an end wall of the pump housing are placed flush on opposite end faces of the damping block.

11. The electrohydraulic drive system of claim 1, wherein the outer diameter of the electric motor housing is selected such that it is larger than the outer diameter of the pump housing.

12. The electrohydraulic drive system of claim 1, wherein the damping block at the bearing point tapers conically in the direction of a seat in the housing of the electric motor, which, with adjacent conical wall parts of the electric motor, delimits a funnel-shaped sound chamber.

13. The electrohydraulic drive system of claim 1, wherein the damping block is manufactured as a stand construction and wherein the housing of the electric motor and the pump housing are connected to the stand formed in this manner on opposite sides.

14. The electrohydraulic drive system of claim 1, wherein the damping block spans a prism with respect to the surrounding area in the form of a hexagonal prism.

15. The electrohydraulic drive system of claim 1, wherein the damping block spans a prism with respect to the surrounding area in the form of an octagonal prism.

16. A electrohydraulic drive system comprising an electric motor and a fluid pump that can be driven by the electric motor via an output shaft and has a rotor, which is rotatably guided in a stator surrounded by a housing of the electric motor, and a pump housing, wherein a damping block is arranged between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and a bearing shell of which is directly supported against the damping block; wherein the damping block at the bearing point tapers conically in the direction of a seat in the housing of the electric motor, which, with adjacent conical wall parts of the electric motor, delimits a funnel-shaped sound chamber.

17. The electrohydraulic drive system of claim 16, wherein the output shaft comprises a coupling point at one of its free end regions for connecting a drive shaft of the fluid pump, said coupling point being surrounded by the damping block, and wherein the bearing point for the output shaft and the coupling point of the drive shaft for the fluid pump are inserted in the damping block on opposite end faces thereof.

18. A electrohydraulic drive system comprising an electric motor and a fluid pump that can be driven by the electric motor via an output shaft and has a rotor, which is rotatably guided in a stator surrounded by a housing of the electric motor, and a pump housing, wherein a damping block is arranged between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and a bearing shell of which is directly supported against the damping block; wherein the damping block spans a prism with respect to the surrounding area in the form of a hexagonal prism.

19. The electrohydraulic drive system of claim 18, wherein the output shaft comprises a coupling point at one of its free end regions for connecting a drive shaft of the fluid pump, said coupling point being surrounded by the damping block, and wherein the bearing point for the output shaft and the coupling point of the drive shaft for the fluid pump are inserted in the damping block on opposite end faces thereof.

20. A electrohydraulic drive system comprising an electric motor and a fluid pump that can be driven by the electric motor via an output shaft and has a rotor, which is rotatably guided in a stator surrounded by a housing of the electric motor, and a pump housing, wherein a damping block is arranged between the electric motor housing and the pump housing in order to reduce noise emissions, said damping block being made of a metal material in a solid construction, and the output shaft passes through the damping block, said output shaft being guided in the damping block in a bearing point which is completely surrounded by the damping block and a bearing shell of which is directly supported against the damping block; wherein the damping block spans a prism with respect to the surrounding area in the form of an octagonal prism.

21. The electrohydraulic drive system of claim 20, wherein the output shaft comprises a coupling point at one of its free end regions for connecting a drive shaft of the fluid pump, said coupling point being surrounded by the damping block, and wherein the bearing point for the output shaft and the coupling point of the drive shaft for the fluid pump are inserted in the damping block on opposite end faces thereof.

* * * * *